US007681270B2

(12) United States Patent
Wyatt et al.

(10) Patent No.: US 7,681,270 B2
(45) Date of Patent: Mar. 23, 2010

(54) MATTRESS WITH FEATURES FOR IMPROVED SUPPORT AND COMFORT

(75) Inventors: Charles Curtis Wyatt, Corona, CA (US); Kenneth Scott Siegner, Calimesa, CA (US)

(73) Assignee: Anodyne Medical Device, Inc., Los Angeles, CA (US)

( * ) Notice: Subject to any disclaimer, the term of this patent is extended or adjusted under 35 U.S.C. 154(b) by 42 days.

(21) Appl. No.: 12/124,581

(22) Filed: May 21, 2008

(65) Prior Publication Data

US 2008/0313817 A1 Dec. 25, 2008

Related U.S. Application Data

(60) Provisional application No. 60/939,198, filed on May 21, 2007.

(51) Int. Cl.
*A47C 27/16* (2006.01)

(52) U.S. Cl. ..... 5/722; 5/727; 5/740; 5/613

(58) Field of Classification Search ..... 5/613, 5/722, 727, 730, 740
See application file for complete search history.

(56) References Cited

U.S. PATENT DOCUMENTS

| | | | | | |
|---|---|---|---|---|---|
| 3,210,781 | A * | 10/1965 | Pollock | ..... | 5/718 |
| 3,419,920 | A * | 1/1969 | Maddux, Jr. et al. | ..... | 5/695 |
| 3,846,857 | A * | 11/1974 | Weinstock | ..... | 5/727 |
| 4,985,951 | A * | 1/1991 | Lacotte et al. | ..... | 5/722 |
| 5,682,631 | A * | 11/1997 | Weismiller et al. | ..... | 5/618 |
| 6,237,173 | B1 * | 5/2001 | Schlichter et al. | ..... | 5/722 |
| 6,311,351 | B1 * | 11/2001 | Murphy | ..... | 5/727 |
| 6,910,236 | B2 * | 6/2005 | Rene | ..... | 5/624 |

* cited by examiner

*Primary Examiner*—Michael Trettel
(74) *Attorney, Agent, or Firm*—Nixon & Vanderhye P.C.

(57) ABSTRACT

A mattress includes features that improve support and comfort. The mattress may include one or more of a head section positioned to support a user's head, a torso section coupled with the head section via a first multi-plane bond, and a foot section coupled with the torso section via a second multi-plane bond. The foot section may be retractable, and the torso section may include a cross-linked foam part and a seat ledge. The seat ledge is positioned to define a catch point for the user upon articulation of the mattress.

9 Claims, 3 Drawing Sheets

MATTRESS WITH FEATURES FOR IMPROVED SUPPORT AND COMFORT

CROSS-REFERENCES TO RELATED APPLICATIONS

This application claims the benefit of U.S. Provisional Patent Application Ser. No. 60/939,198, filed May 21, 2007, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The invention relates to patient care mattress or support surface features and, more particularly, to mattress features that provide better user support and comfort.

There are existing mattress designs purportedly suited for hospitals or other patient care facilities or patient home use. The various mattress sections are typically constructed to accommodate different parts of a user's body, as at least head section, chest/torso section, and leg/foot section. In this manner, the mattress is more comfortable by providing tailored support areas.

In order to connect the various mattress sections, it is typical to use some type of adhesive or stitching across a straight butt joint. Such joints, however, are prone to failure over time, particularly when used with an articulating bed frame. As straight butt joints are lined up over each other, in the various layers, or even in one layer, once the joint starts to give, the whole joint and successive joints are susceptible to failing.

Additionally, when a patient articulates the bed frame, the patient may experience a feeling of sliding to the point of discomfort. This sliding is due to the fact that when seated, a great deal of a patient's weight is on the buttocks, which causes the foam to depress, allowing the patient to slide.

Still further, when seated on an edge of the mattress, the conventional construction is unable to prevent the patient from bottoming out on the frame (see FIG. 5). Often the edges of the frame allow for only a thin layer of foam, which exaggerates the problem, as thin layers of conventional foam bottom out easily. This drawback also renders the mattress less comfortable.

BRIEF SUMMARY OF THE INVENTION

It is always desirable to improve support and comfort characteristics of a mattress, particularly those suited for patient care facilities. Specific areas that could achieve such improvements include better accommodating an articulating frame construction, improving the material of a retracting foot section, improving the bond between various sections of the mattress, and better supporting the patient against the metal sides of the bed.

In an exemplary embodiment, a mattress includes a head section positioned to support a user's head, a torso section coupled with the head section via a first multi-plane bond, and a foot section coupled with the torso section via a second multi-plane bond. The foot section is retractable, and the torso section includes a cross-linked foam part and a seat ledge, which is positioned to define a catch point for the user upon articulation of the mattress.

The seat ledge preferably includes a firm foam wedge. The foot section may include vertical die cuts therein, which may be sized and shaped to facilitate accordion retraction of the foot section. In one arrangement, a bottom surface plane of the foot section is disposed higher, e.g., about 0.75" higher, than a bottom surface plane of the torso section.

In another exemplary embodiment, a mattress includes a head section positioned to support a user's head, a torso section coupled with the head section, and a foot section coupled with the torso section via a multi-plane bond.

In still another exemplary embodiment, a mattress includes a head section positioned to support a user's head, a torso section coupled with the head section, and a foot section coupled with the torso section. In this embodiment, the torso section includes a seat ledge positioned adjacent the foot section to define a catch point for the user upon articulation of the mattress.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
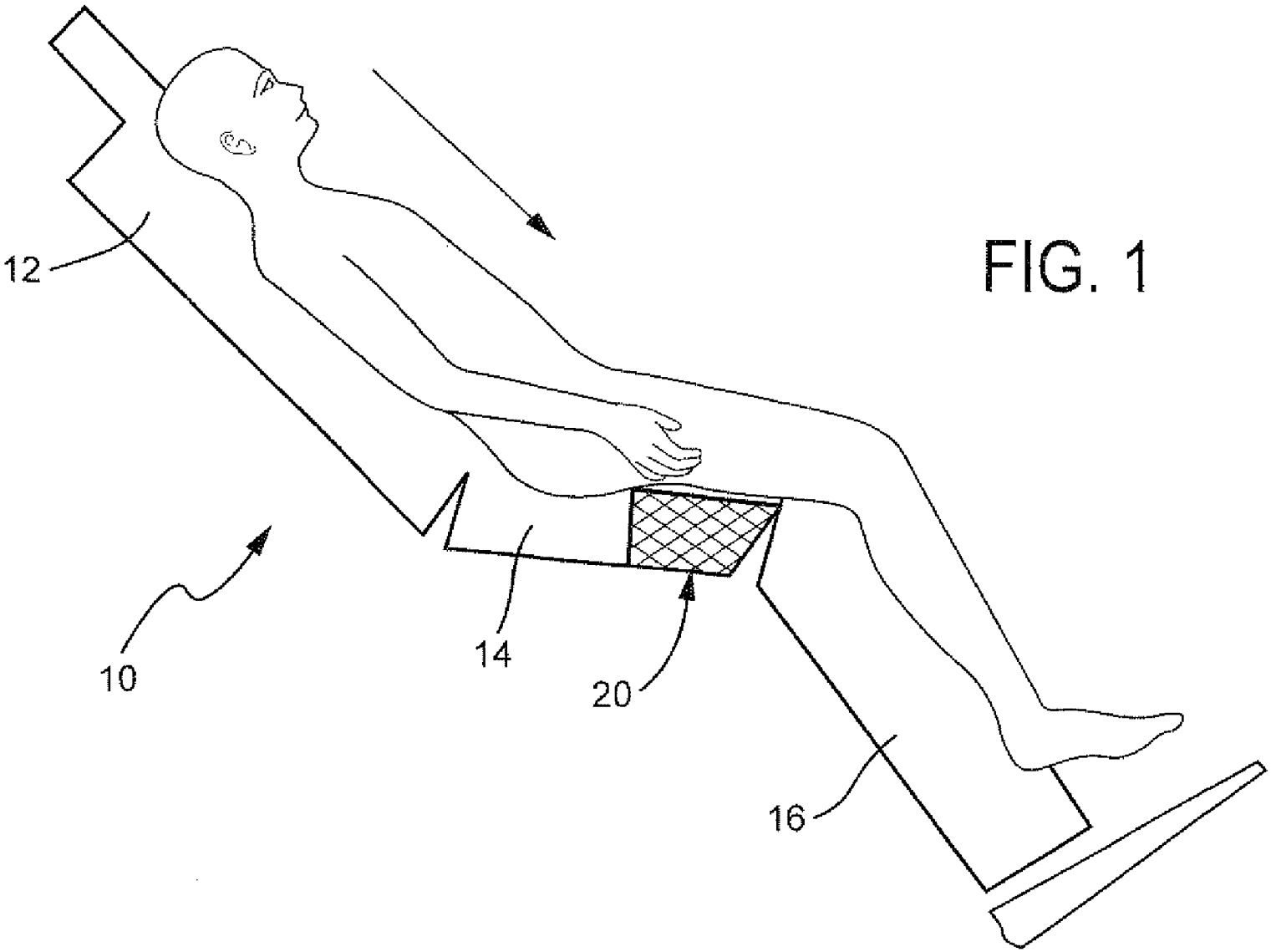
FIG. 1 is a schematic illustration showing an exemplary application of a seat ledge feature in the described mattress.

With reference to the drawings, a mattress 10 cooperable with an articulating bed frame is shown. FIG. 1 shows generally the articulating construction of the mattress 10 relative to an articulating bed frame. Preferably, the mattress is capable of articulating to a seat position. The mattress 10 includes a head section 12, positioned to support a user's head, a torso section 14 coupled with the head section, and a foot section 16 coupled with the torso section 14. The foot section 16 is preferably retractable to accommodate modern bed frames that include a retractable foot section.

Figure 3:
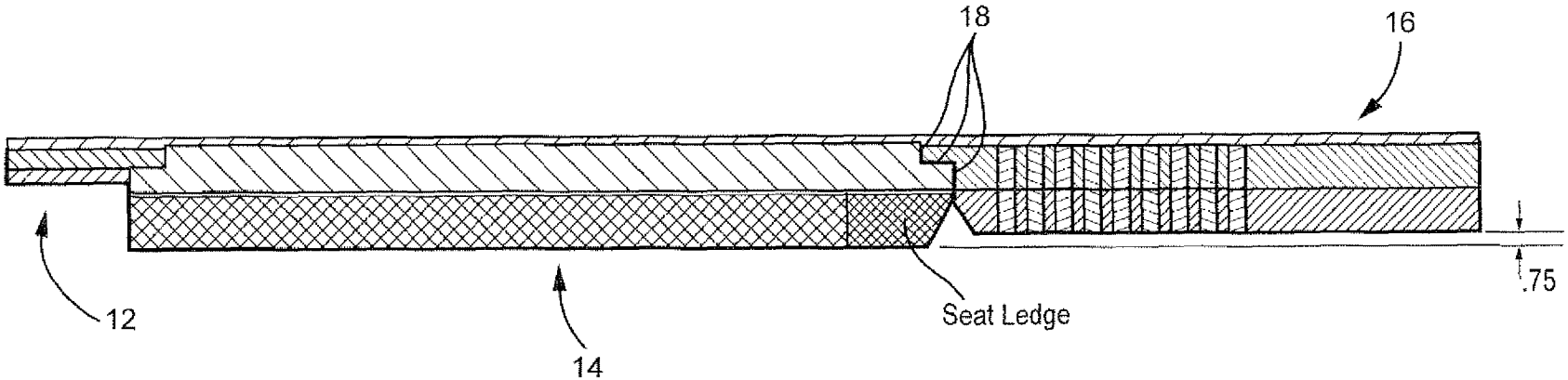
FIG. 3 is a cross-sectional view through a middle of the mattress.
Figure 4:
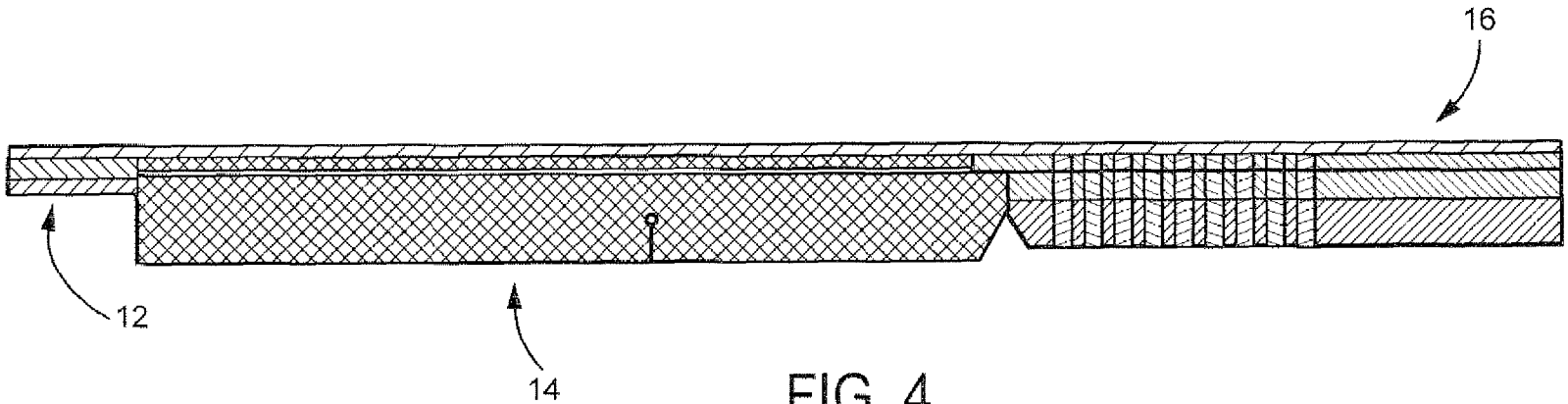
FIG. 4 is a side view of the mattress.

In this context, as shown in FIGS. 3 and 4, the retracting foot section 16 has material removed vertically thereby enabling retraction (compaction) of the foot section 16 while enabling the foot section 16 to hold its shape better than with prior art horizontal cuts. The cuts made in the foam allow the foot section 16 of the mattress to easily retract (i.e., accordion or compress on itself).

Moreover, with continued reference to FIGS. 3 and 4, the foot section 16 is bonded to the torso section 14 using a multi-plane bond 18. Multi-plane bonds shift the vertical bond in each layer of the foam mattress such that the bond from, e.g., the bottom layer does not line up with the bond in the next upper layer, but is moved to the left or right by at least a few inches. Even if the mattress only has one layer, a step is cut at the end that mates to a corresponding step of the next piece of foam, forming a multi-plane bond surface. It has been discovered that a multi-plane bond is more effective than the prior art bond using a straight butt bond line (even for the same bond surface areas). This is especially important on the dense/heavy foot section 16 of the mattress. A similar bond 18 may be provided between the torso section 14 and the head section 12.

The torso section 14 preferably includes a seat ledge 20 positioned adjacent the foot section 16. The seat ledge 20 provides more support to the patient during articulation toward the seating position (see FIG. 1). The seat ledge 20, which preferably has wedge type shape, is made of foam with a higher ILD and density than the surrounding foam. The seat ledge 20 therefore compresses less than the surrounding foam when the patient applies weight to that section of the mattress. As noted above, with previous designs, when the bed articulates, the patient may have a sensation of sliding down the mattress. The seat ledge 20, which comprises a much firmer foam wedge, acts as a catch to the patient and lends a certain amount of hold and comfort to the patient during articulation of the bed frame.

Figure 5:
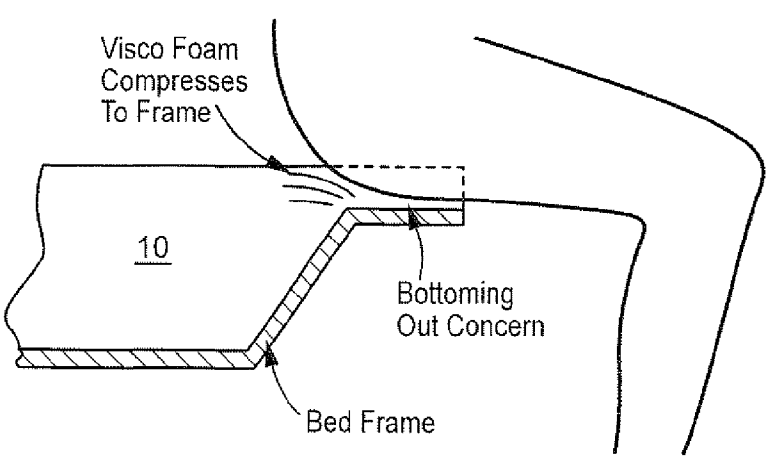
FIG. 5 Prior Art
FIG. 5 illustrates a problem with a conventional design.
Figure 2:
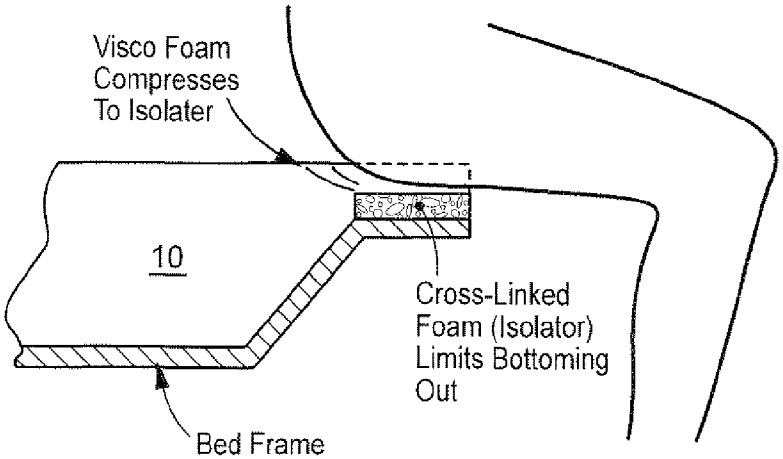
FIG. 2 is a cross-sectional view showing a feature of the mattress.

FIG. 2 shows a feature of the mattress to better support a patient sitting on an edge of the mattress. A cross-linked foam 22 is added under the flanged sides of the mattress 10. Cross-linked foam is a polyethylene closed foam, different from a visco-elastic foam, which has very slow recovery. An example of visco-elastic foam is Tempurpedic® foam. The cross-linked foam is much more dense, stiff and supportive than Tempur foam. Many bed frames have platform components that are not all in the same plane, thus allowing for only a thin layer of foam over these areas. For example the Versa Care® bed frame by Hill-Rom has lips or flanges on the sides of the bed that only allow 2" of foam. The cross-linked foam works well when used to isolate the patient from these bedside flanges. For example, as little as ½" of cross-linked foam in conjunction with 1½" of Tempur foam will allow comfort yet prevent bottoming out by the patient. Tempur foam is a nice compliment/interface to the patient but not very effective by itself in a reasonable thickness to protect the patient from localized pressure in these areas. The firmer and denser cross-linked foam has an advantage in that it is a much better isolator of the patient from the metal sides of the bed. The cross-linked foam construction prevents the patient from bottoming out on the frame when seated on an edge of the mattress, which as noted is a problem of prior art visco foam mattresses as shown in FIG. 5. This construction also enables the use of a much lower profile thickness, as tis as just ½", which is significant for use in patient care beds with railings and also reduces costs, particularly since Tempur foam in a thickness to prevent bottoming out is more expensive thin a thin layer of cross-linked foam.

The head section 12 includes a firmer more supportive foam. Using a firmer foam in the head section 12, as opposed to the foot section 16 or even the trunk section 14 is often required as the head section 12 may be required to be of a thinner dimension due, again, to the design of the bed frame, particularly in the raised position. If the head portion of the mattress is too thick, it may lean the patient forward in the raised position.

As shown in FIG. 3, a bottom surface plane of the foot section 16 may be disposed higher than a bottom surface plane of the torso section 14. For example, the bottom surface plane of the foot section may be disposed about 0.75" higher than the bottom surface plane of the torso section 14. In this manner, the mattress 10 more accurately nests with certain bed frame designs, such as the VersaCare bed deck.

With the mattress structure described herein, added features provide for improved support and comfort to the user. The improved mattress is particularly suited for hospitals or other patient care facilities.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A mattress comprising:

a head section positioned to support a user's head;

a torso section coupled with the head section via a first multi-plane bond, the torso section including a cross-linked foam part and a seat ledge, the seat ledge being positioned to define a catch point for the user upon articulation of the mattress; and a foot section coupled with the torso section via a second multi-plane bond, the foot section being retractable.

2. A mattress according to claim 1, wherein the seat ledge comprises a firm foam wedge.

3. A mattress according to claim 1, wherein the foot section comprises vertical die cuts therein.

4. A mattress according to claim 3, wherein the vertical die cuts are sized and shaped to facilitate accordion retraction of the foot section.

5. A mattress according to claim 1, wherein a bottom surface plane of the foot section is disposed higher than a bottom surface plane of the torso section.

6. A mattress according to claim 5, wherein the bottom surface plane of the foot section is disposed about 0.75" higher than the bottom surface plane of the torso section.

7. A mattress comprising:

a head section positioned to support a user's head;

a torso section coupled with the head section; and a foot section coupled with the torso section via a multi-plane bonds wherein the torso section includes a seat ledge positioned adjacent the foot section to define a catch point for the user upon articulation of the mattress.

8. A mattress according to claim 7, wherein the foot section is retractable.

9. A mattress according to claim 7, wherein the torso section is coupled with the head section via another multi-plane bond.

* * * * *